US005297939A

United States Patent [19]

Orth et al.

[11] Patent Number: 5,297,939

[45] Date of Patent: Mar. 29, 1994

[54] AUTOMATIC CONTROL FOR BILGE & SUMP PUMP

[75] Inventors: Stephen R. Orth, Chicago; Burton L. Siegal, Skokie, both of Ill.

[73] Assignee: Johnson Pumps of America, Inc., Schiller Park, Ill.

[21] Appl. No.: 11,810

[22] Filed: Feb. 1, 1993

[51] Int. Cl.[5] ..... F04D 15/00

[52] U.S. Cl. ..... 417/40; 200/84 C

[58] Field of Search ..... 417/40, 41; 200/84 C

[56] References Cited

U.S. PATENT DOCUMENTS

| | | | |
|---|---|---|---|
| D. 306,447 | 3/1990 | Whitley, II . | |
| 2,844,678 | 7/1958 | Nielesen . | |
| 3,316,845 | 5/1967 | Schumann . | |
| 3,999,890 | 12/1976 | Niedermeyer . | |
| 4,081,639 | 3/1978 | Tice | 200/84 C |
| 4,165,204 | 8/1979 | Nielsen . | |
| 4,186,419 | 1/1980 | Sims . | |
| 4,275,995 | 6/1981 | Taylor . | |
| 4,345,879 | 8/1982 | Steiner | 417/40 |
| 4,441,860 | 4/1984 | Tsujimoto | 417/40 |
| 4,805,066 | 2/1989 | Mergenthaler . | |
| 4,917,135 | 4/1990 | Duncan . | |
| 4,941,806 | 7/1990 | Brown et al. . | |
| 4,943,210 | 7/1990 | Bailey, Jr. et al. | 417/40 |
| 5,025,827 | 6/1991 | Weng | 417/40 |

*Primary Examiner*—Richard A. Bertsch
*Assistant Examiner*—David W. Scheuermann
*Attorney, Agent, or Firm*—Hill, Steadman & Simpson

[57] ABSTRACT

An automatic control for a liquid pump which assures that the pump starts pumping when the liquid reaches a predetermined level and the pump is stopped when the level has fallen to a second predetermined level. The control includes a permanent magnet mounted in a float that is contained within a float chamber and which has a bottom opening through which the liquid can enter the float chamber. A top portion of the float chamber is provided with a one-way valve so as to allow air to escape from the float chamber, but which prevents air from entering the float chamber such that when the float moves up with the liquid, the magnet actuates a magnetic responsive switch such as a reed switch to cause the motor to start to drive the pump. As the pump lowers the level of the liquid, the level of the liquid in the float chamber does not fall because of the partial vacuum within the top of the float chamber and, thus, the magnet continues to energize the pump. When the liquid level falls to the bottom of the float chamber, air rushes into the chamber and allows the retained liquid within the float chamber to fall out the bottom and the magnet bearing float falls to the bottom which turns off the pump motor.

8 Claims, 2 Drawing Sheets

AUTOMATIC CONTROL FOR BILGE & SUMP PUMP

BACKGROUND OF THE INVENTION

1. Field of the Invention

This invention relates in general to an automatic control for bilge and sump pumps and in particular to a magnetically controlled pump.

2. Description of Related Art

Limit switches have traditionally been utilized on countless types of commercial bilge and sump pumps. The limit switch may be mounted within a hinged float and be energized by a rolling element which engages the switch actuator when the float has reached an angle that is sufficient for the rolling element. The pump will remain energized until the float has fallen to an angle which allows the rolling element to roll away from the switch actuator. There is a problem with this system in that the two electrical conductors penetrating the float must be sealed. Other limit switches that are commonly employed are enclosed in the pump motor sealed chamber. This requires a membrane or other means that will allow a pivoted or otherwise constrained float means to communicate its position to the switch actuator without allowing liquid to enter the sealed chamber. Such systems result in actuation and de-actuation levels which are variable due to added friction and tolerance buildup.

Mercury switches have been used within a hinged float instead of a limit switch and a rolling element. These structures have the same sealing problems and are less precise in the set points for controlling the pump as the float rises and falls with the liquid level. The liquid mercury exaggerates the tendency to false trigger the motor when in a dynamic environment such as a bilge pump in a small boat. Also, a pair of electrodes at both the beginning and end pumping liquid levels have been used with a logic circuit and a power relay that is energized when the upper pair of contacts close and remains energized until the lower pair of contacts is open. Problems occur such as maintaining conductivity of contacts which are intermittently submerged in a dirty, oily environment in which solids can be baked onto the contacts creating an insulating barrier. Both limit and mercury switch type controls must turn off the pump motor before the float bottoms or the motor would run continuously to destroy the motor or to exhaust the battery.

In a dynamic application such as the bilge of a small boat as the boat bounces from wave to wave, the pivoting float will cause the switch to close many times per minute even without water in the bilge. This needlessly consumes the switch contact so that the system has a relatively short life.

See also U.S. Pat. Nos. 3,316,845, 4,345,879, 4,917,135, 4,941,806, 5,025,827, 2,844,678, 3,999,890, 4,165,204, 4,186,419, 4,275,995, 4,805,066, and Design 306,447.

SUMMARY OF THE INVENTION

The present invention provides an automatic control for a bilge or sump pump where a motor is mounted in a sealed housing and has a separate float chamber that communicates with the pump inlet. A magnet is mounted in a float and moves up and down in the float chamber as the level of the fluid changes. At the top of the float chamber, a one-way valve, which might be a flapper type, is mounted so as the liquid level rises, air can pass out of the flapper valve so that the water level rises to allow the magnet to energize a reed switch to start the motor. As the motor starts to pump the water, the water level falls. However, due to the one-way valve in the float chamber, the liquid level in the float chamber does not fall with the level of the water until the liquid level has reached the bottom of the float chamber at which time air can enter the float chamber and the liquid then passes out of the float chamber thus allowing the float to move downwardly deactuating the motor. The level in the float chamber remains higher than the liquid level being pumped because a partial vacuum is formed in the float chamber above the float which holds the internal liquid above the external liquid level.

It is an object of the present invention to provide a control for a bilge pump which eliminates multiple false triggering due to bouncing or turning of the boat.

It is an object of the invention to provide an improved bilge pump control which positively turns on the bilge pump when the water level reaches a predetermined level and continues to energize the pump until the water level has been pumped to a second predetermined level.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
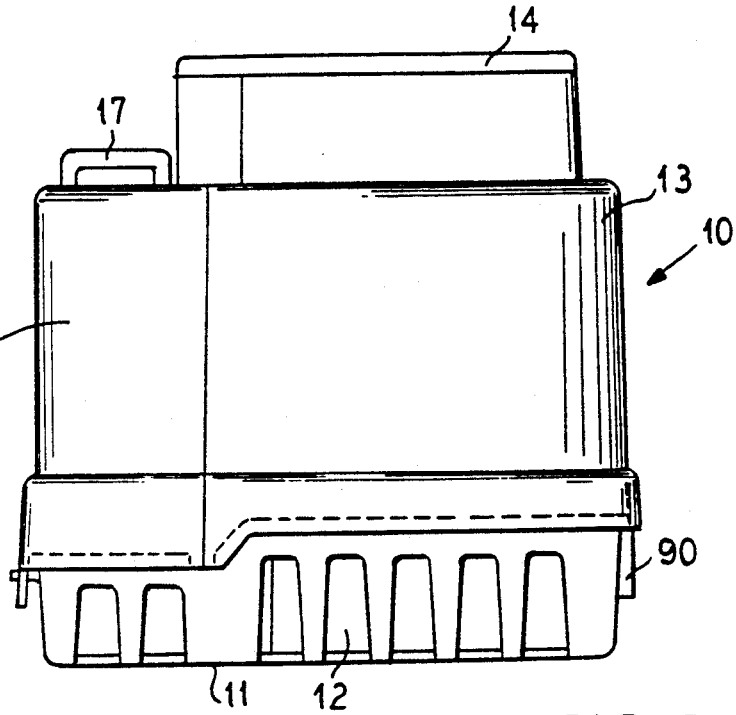
FIG. 1 is a side plan view of the pump and control of the invention.
Figure 2:
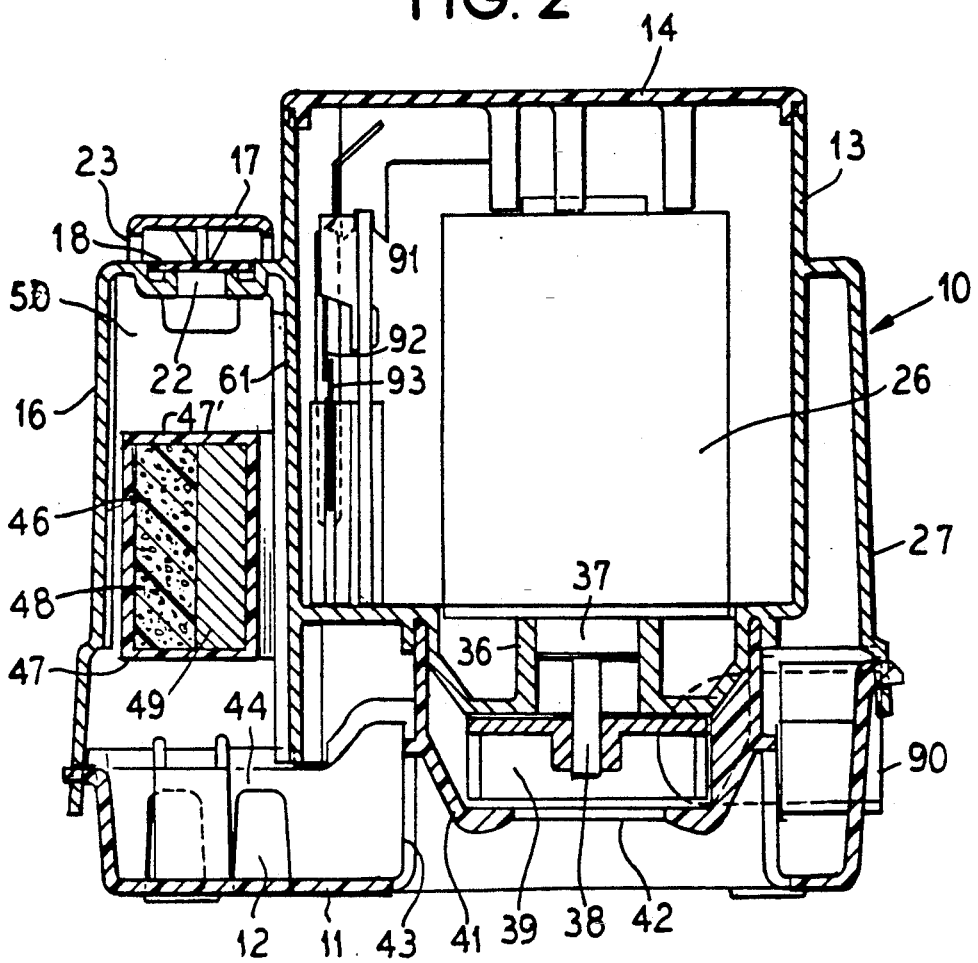
FIG. 2 is a sectional view illustrating the invention.
Figure 3:
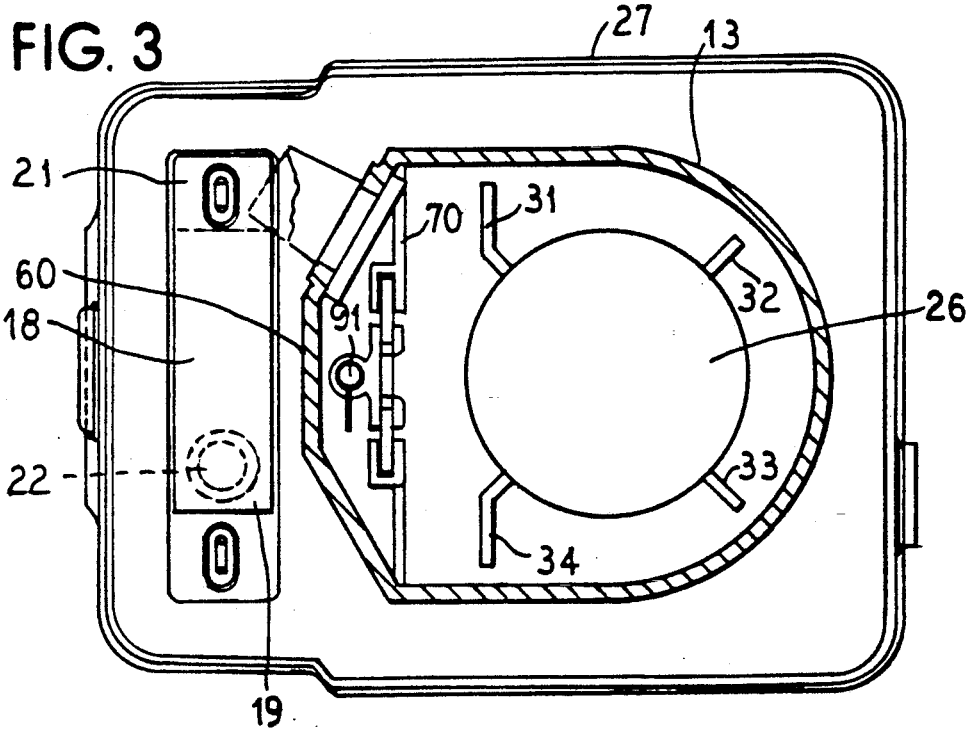
FIG. 3 is a sectional view illustrating the invention.

The Figures illustrate the sump pump 10 of the invention which has a bottom 11. Liquid input louvers 12 are formed adjacent the bottom as shown in FIGS. 1 and 2 so as to allow liquid to pass into the bilge pump 10. A housing 13 encloses the pump and control and has a top 14 which can be removed so as to insert the motor 26 into the housing. A float chamber 50 is formed by a wall 16 and is attached to the housing 13 as illustrated in FIGS. 1-5.

Figure 4:
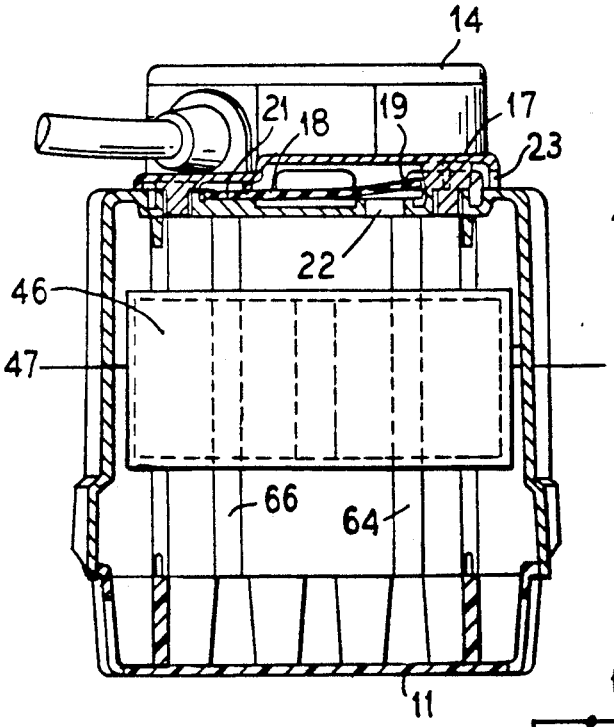
FIG. 4 is a sectional view illustrating the flapper valve and float.

At the top of the float chamber 16 is mounted a cover baffle portion 17 with openings 23 to allow air to pass therethrough and which covers a flapper valve 18 as shown in FIGS. 2 and 4. The flapper valve 18 may be a generally rectangular shaped strip of flexible material such as rubber which has its end 21 attached to the top of the float chamber 50 as shown in FIG. 4 and has its opposite end 19 free to move relative to an air opening 22 such that air can pass out of the float chamber 50, but is prevented from passing into the float chamber through the opening 22.

Figure 5:
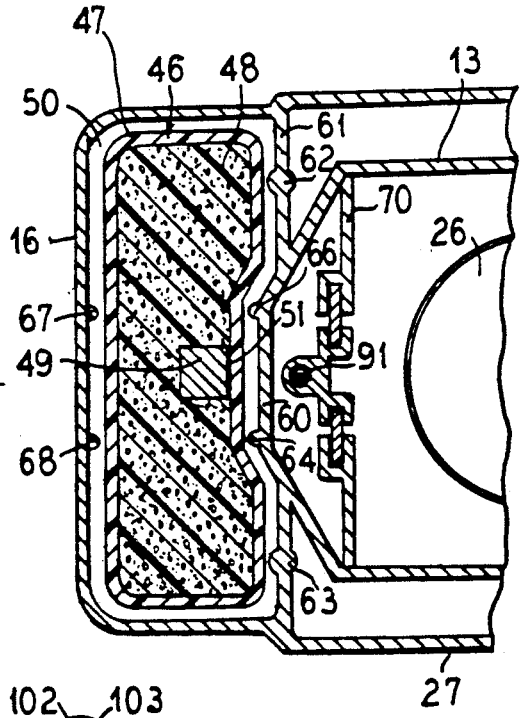
FIG. 5 is a sectional view through the float.

A float 46 is mounted in float chamber 50 and is formed with an outer cover 47 and lid 17'. Mounted therein is a permanent magnet 49. The remaining portion of the float 46 is filled with foam material 48 as shown in FIGS. 2 and 5 or if the lid 47' is sealed to the outer cover 47, foam material 48 may be omitted. The wall 61 between the float chamber 50 and the motor housing 13 is formed with a projection 60 which is receivable in an indentation 51 of the float 46 as illustrated in FIG. 5. Ribs 62, 63, 64, 66 and 67 and 68 are mounted in the float chamber 50 so as to maintain minimum contact between the float 46 and the walls of the float chamber 50 so as to reduce friction.

A reed type switch 91 with contacts 92 and 93 as shown in FIG. 2 is mounted on support wall 70 in motor housing 13 and the normally opened reed switch 91 is closed when the magnet 49 in the float 46 moves up into the float chamber 50 to the motor start position.

The motor 26 is supported by supports 31, 32, 33 and 34 and the motor housing 13 and has an output shaft 38 which extends through a seal 37 positioned by a collar 36 and said shaft carries an impeller 39 thereon.

Figure 6:
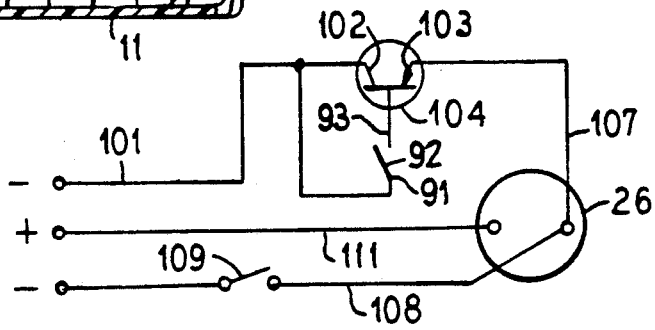
FIG. 6 is an electrical schematic of the motor control circuit.

In operation, water passes through the openings 12 and through the float chamber bottom opening 44 into the float chamber 50 causing the float 46 to rise in the float chamber 50. As the float 46 rises in the float chamber 50, air passes out the flapper valve 18 through the opening 22 until the level of liquid in the float chamber 50 has moved the float 46 to a level such that the magnet 49 closes the reed switch 91 contacts 92 and 93. As shown in FIG. 6, when the reed switch 91 is closed, power is supplied to the motor 26 through a power transistor 104 and the motor 26 is energized. Power lead 101 is connected to one contact 92 of the reed switch 91 and to the collector 102 of transistor 104. Contact 93 is connected to the base of transistor 104. The emitter 103 is connected to lead 107 of motor 26. The other power lead 111 is connected to motor 26. A manual operation switch 109 can be closed to connect power to lead 108 of motor 26 so that the motor 26 can be energized by switch 109. The pump motor 26 drives the impeller 39 which receives liquid from internal louvers 43, through impeller inlet 42 and pumps water through the outlet 90 to lower the water level. As the water level is lowered, the float 46 moves downwardly only a small amount due to the partial vacuum in the float chamber 50 above the float 46. Since the flapper valve 18 does not allow air to pass down through the opening 22, the liquid in the float chamber 50 will remain higher than the liquid level which is being pumped by the motor 26. The motor 26 continues to pump the liquid through the discharge opening 90 until the level of the liquid falls to the tops of louvers 12 at which time air can enter the float chamber 50 through opening 44, thus allowing the liquid in the float chamber to discharge through the opening 44. This causes the float 46 to drop in the float chamber such that the magnet 49 moves away from the contacts 92 and 93 of the reed switch 91 allowing the reed switch 91 to open, thus stopping the motor 26.

The vented protective cover 17 protects the flapper valve 18 from debris and other mechanical interferences. A perimeter portion 27 of the motor housing 13 is shown.

In the invention, the magnet 49 is placed as close as practical to the reed switch 91 and it is placed off-center relative to the float 46. The float 46 and the float chamber 50 are asymmetrical so that the float cannot be rotated 180° during assembly whereby the magnet 49 will stay closely adjacent the reed switch 91. It is to be realized, of course, that the partition 61 between the magnet 49 and the read switch 91 must allow magnetic flux to pass therethrough. The ribs 62, 63, 64, 66, 67 and 68 allow only line contact between the float 46 and the float chamber 50 so as to maintain friction at a minimum.

The invention allows control switching for millions of times. It also eliminates the need to seal the electrical leads from the reed switch.

The invention will not false start the pump motor due to bouncing of the float due to wave action. The motor can be turned on with as deep a level as desired and turned off with as shallow a level as desired. This allows a more powerful bilge pump to be used without requiring it to be turned on and off every few seconds due to a small differential between the turn-on and turn-off points.

Although the invention has been described with respect to preferred embodiments, it is not to be so limited as changes and modifications can be made which are within the full intended scope of the invention as defined by the appended claims.

I claim as our invention:

1. A control for a pump comprising, a housing, a pump motor mounted in said housing, an impeller attached to said pump motor and mounted in a lower portion of said housing so as to impel liquid through a discharge opening in said housing, a float chamber attached to said housing, a float moveably mounted in said float chamber, a magnet mounted in said float, a magnetic responsive switch mounted adjacent said float chamber so that it can be actuated by said magnet as said float moves in said float chamber to turn on and off said pump motor, a one-way valve mounted in an upper portion of said float chamber so as to allow air to pass out of the float chamber as the liquid level in the float chamber rises, but which prevents air from entering the float chamber as the liquid level outside the float chamber falls, said float chamber's lower portion having an opening to receive and discharge liquid.

2. A control for a pump according to claim 1 wherein said magnetic responsive switch is a read switch.

3. A control for a pump according to claim 1 wherein said one-way valve comprises an opening formed in an upper portion of said float chamber and a flexible strip attached to said float chamber and extending over said opening.

4. A control for a pump according to claim 1 wherein said magnetic responsive switch is sealed from the liquid which is pumped by said impeller.

5. A control for a pump according to claim 1 including a plurality of louvers formed in a lower portion of said housing so as to let liquid into said float chamber and said impeller.

6. A control for a pump according to claim 1 including a protective cover mounted over said one way valve to prevent debris from clogging said valve.

7. A control for a pump according to claim 1 wherein said float has a vertically extending indentation and said float chamber has a projecting portion which is receivable within said indentation.

8. A control for a pump according to claim 7 including at least one vertical rib attached to the inner wall of said float chamber so as to make contact with said float as it moves up and down in said float chamber.

* * * * *